US005353108A

United States Patent [19]

Tsukamoto

[11] Patent Number: 5,353,108

[45] Date of Patent: Oct. 4, 1994

[54] APPARATUS FOR CLEANING PRINTED PAPER

[75] Inventor: Masahide Tsukamoto, Nara, Japan

[73] Assignee: Matsushita Electric Industrial Co., Ltd., Osaka, Japan

[21] Appl. No.: 725,667

[22] Filed: Jul. 3, 1991

[30] Foreign Application Priority Data

Jul. 5, 1990 [JP] Japan ..... 2-177720
Aug. 10, 1990 [JP] Japan ..... 2-212873

[51] Int. Cl.[5] ..... G03G 21/00

[52] U.S. Cl. ..... 355/296; 156/281; 156/389

[58] Field of Search ..... 355/296, 297, 301, 308; 156/247, 281, 344, 389, 390, 584; 101/33, 34, 478

[56] References Cited

U.S. PATENT DOCUMENTS 3,792,913 2/1974 Simmons ..... 355/74 X
4,909,151 3/1990 Fukui et al. ..... 101/450.1
5,006,189 4/1991 Tsukamoto et al. ..... 156/247

*Primary Examiner*—Leo P. Picard
*Assistant Examiner*—Christopher Horgan
*Attorney, Agent, or Firm*—Wenderoth, Lind & Ponack

[57] ABSTRACT

A cleaning apparatus is designed to press a heat-soluble resin which is heated and in a tacky state to a heat-soluble ink on an erasable paper having a surface treated with releasing agent, and to peel off the heat-soluble ink.

4 Claims, 2 Drawing Sheets

APPARATUS FOR CLEANING PRINTED PAPER

BACKGROUND OF THE INVENTION

1. Field of the Invention

The present invention relates to a cleaning apparatus capable of reusing once used printed paper by cleaning, and a printer and erasable paper.

2. Description of the Prior Art

In the recent so-called OA (Office Automation) trend, printer paper and copying paper have come to be used in a massive quantity. Accordingly, it has led to a problem of damage to the global environment by collecting forest trees. Conventionally, regarding this issue, the ink was removed from the waste paper, and it was immersed and regenerated into recycled paper. Recently, however, a cleaning method of easily removing the characters and images on a once used paper was developed. The detail is disclosed in Japanese Patent Application of publication No. 63-128946 and U.S. patent application Ser. No. 07/357,597. According to this invention, using a paper having the surface treated with a releasing agent (i.e.-an erasable paper), printing is effected on it, and the printing is covered with a molten heat-soluble resin (cleaning agent) for cleaning, and it is cooled to remove the printing of the characters and images together with the heat-soluble resin. This method is very effective, and the paper with releasing treatment may be used hundreds of times repeatedly, and by using the printing ink in the same material as the heat-soluble cleaning agent, the cleaning agent may be also used hundreds of times. It is very economical, and the forest resources are not destroyed. In this method of cleaning the erasable paper, since heating and cooling are repeated, it took a long time in the cleaning process, and the processing speed was limited. Besides, the loss of heat energy was significant.

SUMMARY OF THE INVENTION

It is hence a primary object of the invention to present an apparatus for cleaning printed paper capable of cleaning at a high speed and at a low heat energy loss in a simple constitution.

To achieve the above object, a cleaning apparatus of the invention peels off heat-soluble ink by pressing a heat-soluble resin in a tacky state by heating to a printed matter printed with the heat-soluble ink on an erasable paper having a surface treated with a releasing agent. Therefore, by employing the cleaning apparatus of the invention, the once used printed paper may be used repeatedly at high speed without a great heat energy loss. In a printer furnished with this apparatus of the present invention, using a used printed paper, new print is made. As a result, the paper consumption in an office is greatly reduced. In an office, a large quantity of copies can be made economically, and the forest resources may not be consumed in large quantities. At home, when a specific quantity of printing paper is prepared, massive newspaper facsimile may be possible.

DESCRIPTION OF THE PREFERRED EMBODIMENTS

Figure 1:
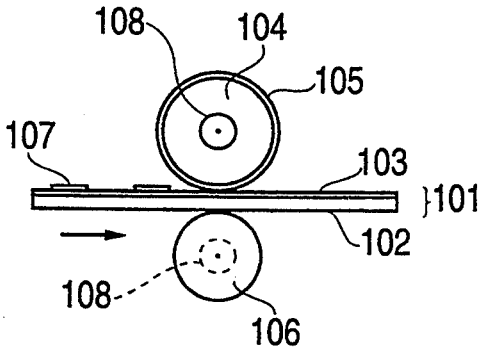
FIG. 1 is a drawing showing portions of a cleaning apparatus of the present invention.

FIG. 1 is a diagram showing portions of a cleaning apparatus of the present invention.

An erasable paper 101 has a surface of a substrate 102 coated with a releasing layer 103.

Such material is already used as the releasing paper, in the liner of double coated adhesive tape or base paper of a sheet-like resin product . The erasable paper convenient for employing the invention actually is described later. Element 107 is a heat-soluble ink (for example a toner used in electrophotography) printed on the erasable paper. Element 104 is an adhesion roller mounting a heat-soluble resin 105 in molten state thereon. Element 106 is a platen for pressing the erasable paper to the adhesion roller. To melt the heat-soluble resin into a molten state, a heat source 108 for heating may be incorporated either in the adhesion roller 104 or, as shown by a broken line, in the platen 106. FIG. 1 shows only the minimum required parts of the present invention, and the driving system for rotating the rollers, the pressure mechanism, and the mechanism for peeling off the erasable paper are not shown.

When the heat-soluble resin is heated and is molten, by passing the printed erasable paper between two rollers as shown in FIG. 1, the heat-soluble ink on the erasable paper is enveloped into the heat-soluble resin on the adhesion roller, and is peeled off from the surface of the erasable paper. The surface of the heat-soluble resin initially applied on the adhesion roller is gradually covered with the heat-soluble ink, and thereafter the heat-soluble ink acts for the initial heat-soluble resin, and the adhesiveness of the adhesion roller is maintained. In other words, the heat-soluble resin on the adhesion roller builds up its thickness gradually as the erasable paper is cleaned repeatedly, but the cleaning performance does not deteriorate. Here is the essential point of this invention, and what is consumed is only the heat-soluble ink and the heat energy. It is enough to keep the adhesion roller heated, and to supplement the energy that is removed every time the erasable paper is charged, and the energy consumption is very small.

As the heat-soluble resin on the adhesion roller, the toner used in the electrophotography is preferably used. As the heat-soluble resin, if a resin having a lower softening temperature than the toner is used, the toner laminated thereon is harder, and the surface is not smooth, and the toner on the erasable paper cannot be enveloped, or at the melting temperature of the toner, the heat-soluble resin may be too soft, and the heat-soluble resin may be transferred onto the erasable paper.

If the softening temperature of the heat-soluble resin is higher than that of the toner, the adhesiveness is not enough at the temperature where the toner is adhesive, and the heat-soluble resin is not softened, and the toner enveloping capacity is lacking, and hence the toner cannot be removed.

In the above explanation, the adhesion roller is used, but as clear from the description herein, it is not at all necessary that it should be in roller form. Obviously, it may be a sheet or plate or the like. It is a matter relating to the designing of the apparatus.

Figure 2:
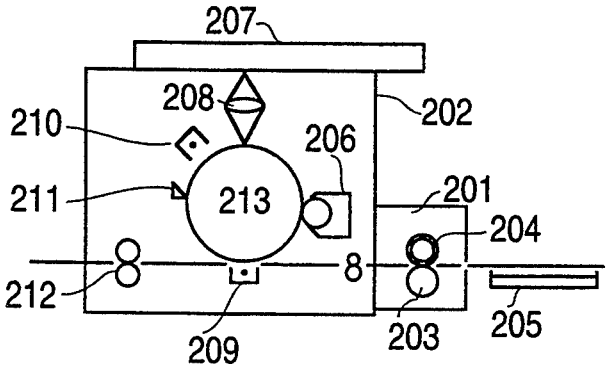
FIG. 2 is an example of copying apparatus incorporating the cleaning apparatus of the present invention.

FIG. 2 is an embodiment of a printing machine (copying machine) incorporating the cleaning apparatus of the present invention in FIG. 1. The cleaning apparatus 201 at least comprises an adhesion roller 204 for holding the heat-soluble resin and a platen 203. The heat-soluble resin is heated and is in a tacky state. A printed erasable paper is inserted from the right side, and is pressed against the heat-soluble resin by the platen 203, and the toner is peeled off clean. This is a simplified drawing, and the paper feed roller and peeling claw and the like are not shown. The mechanical composition itself is considerably different in the case of Embodiment 2. It is, however, not departed from the true spirit of the invention. Element 202 is a copying unit, which is same as a copying apparatus of indirect electrophotographic type widely known hitherto. That is, an image of an original put on the original plate 207 is focused and exposed on the surface of the photoconductive drum by a lens system 208. Prior to this, an electric charge is put on the surface of the photoconductive drum by a corona charger 210. The latent image formed by exposure is developed by a developer 206, and a toner image is formed on the surface of the photoconductive drum. This image is transferred on the paper by a transfer charger 209, and the toner is molten and pressed by a fixer 212 to fix. The toner left over on the surface of the photoconductive drum is cleaned by a cleaning blade 211, and one cycle of copying process is over. Element 205 is an erasable paper cassette.

In FIG. 2, the copying machine is explained, but a method of forming a latent image by emitting laser light instead of focusing the image on the photoconductor drum is widely known, and it is easily supposed that such a printing press may be devised. That is, before feeding paper to the laser printer, the used erasable paper is supplied by using the cleaning apparatus, so that a printer not wasting the paper resources may be realized.

Such a printing machine is not different from the conventional copying machine or printer of electrophotographic type in its printing unit. Therefore, it is also possible to print on plain paper. When printing on plain paper, it is enough not to pass through the cleaning apparatus. That is, it is enough to install a paper feeding unit for plain paper other than the cleaning apparatus. Or if there is only one inlet, the plain paper and the erasable paper may be automatically recognized, and the path may be changed over.

EMBODIMENT 1

Using releasing paper (CPSM Lintec Corporation product classification name) as the erasable paper, it was copied by a Canon copier (FC-5II). It was printed in the same fashion as a plain paper, being fixed so firmly that it could not be peeled off by rubbing with a hand. Using an iron-made heat roller coated with a releasing agent (fluororesin) as the platen, a rubber roller as the adhesion roller coated with a heat-soluble resin (CHEMIT FILM KF1000#80, Toray Co., Ltd. ) with a melting temperature of about 100 deg. C., an apparatus composed as shown in FIG. 1 was manufactured. By rotating the platen, keeping the surface temperature at 130 deg. C., an erasable paper is inserted between the platen and the adhesion roller so that the toner surface may contact the adhesion roller, and it was fed in while pulling so that it may not be wound on the adhesion roller from the exit side at a speed of 2 cm/sec, and the toner was cleanly peeled off from the erasable paper.

EMBODIMENT 2

Using a releasing paper (EK100E, Lintec Corporation, product classification name) as the erasable paper, it was copied in the same manner as in Embodiment 1. Fixing was better than in Embodiment 1. In the same apparatus as in Embodiment 1, with the surface temperature of the platen also at 130 deg. C., the paper was sent in between the two rollers by rotating at a peripheral speed of 8 cm/sec, and the erasable paper was wound in on the adhesion roller, and the two rollers were rotated reversely before the terminal end of the erasable paper is wound in, and it was pulled out. The result was successful, and the toner fixing on the erasable paper was completely cleaned. Besides, when this process was repeated many times and the surface of the adhesion roller was covered with toner, the result was not different at all. As compared with Embodiment 1, the cleaning speed was higher, which was considered because the contact time on the adhesion roller was longer.

EMBODIMENT 3

In Embodiment 1, before the erasable paper gets in between the adhesion roller and platen, it was passed into the rollers heated to 150 deg. C. in the preheating zone, and the temperature of the adhesion roller was lowered to 90 deg. C., and a cleaning apparatus provided with a releasing pawl was disposed near the exit of the adhesion roller was manufactured. In this cleaning apparatus, at the feed speed of 3 cm/sec, the erasable paper was passed through this cleaning apparatus. The result was excellent, and the erasable paper was neatly cleaned, and, without winding around the adhesion roller, was discharged. The temperature of the adhesion roller was low, and the tackiness was lower, but since the toner had been preliminarily melted on the erasable paper by preheating, it was assumed that the toner was cleanly removed.

These embodiments are only few examples, and it is evident that there are many mechanical constitutions for peeling off the heat-soluble resin from the sheet treated with releasing agent by using a resin which becomes adhesive by heating. Such examples are not apart from the scope of the present invention.

Figure 3:
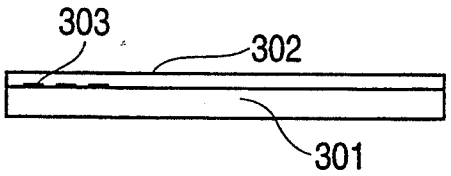
FIGS. 3 to 5 show each sectional view of an erasable paper of the present invention.

FIG. 3 shows a sectional view of an example of erasable paper used in the present invention. Element 301 is a support. The material is plastic sheet, paper, or the like. Element 303 is a mark displaying that it is erasable, which is made by printing. Element 302 is a releasing layer. When the material of the support is paper, it is usually coated with a sealing layer. Adjusting the adhesive power of the ink and toner of the characters and images put on the releasing layer, it is designed to be removed easily by the cleaning apparatus mentioned above or not to be removed by ordinary handling.

Figure 5:
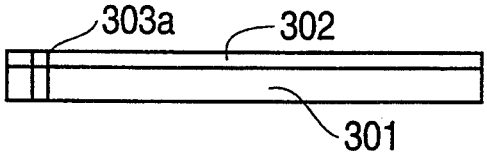

The thus prepared erasable paper has its mark, and is easily distinguished from the ordinary paper, or the machine can recognize it to sort it out automatically if mixed. In FIG. 3, the mark shows that it was printed before the releasing treatment, but it is not necessarily required, and it may be printed after treatment. Or the mark may be printed on the back side. Or it may be indicated by opening a hole 303*a* as shown in FIG. 5.

Figure 4:
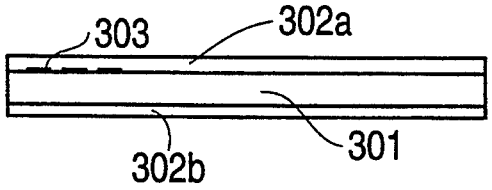

Of course, releasing layers 302*a* and 302b may be easily applied on both sides of the support 301 as shown in FIG. 4. In this case, the mark 303 may indicate that the paper has the releasing layers at both sides thereof.

What is claimed is:

1. A cleaning apparatus for cleaning an erasable paper having a surface which has been treated with a releasing agent and on which a pattern of a heat-soluble ink has been printed, comprising:

an adhesion roller having an outer surface made of a heat-soluble resin which has been placed in a tacky state by heating; and a platen for pressing said erasable paper onto the outer surface of said adhesion roller;

said adhesion roller rotating to transport said erasable paper inserted between the outer surface of said adhesion roller and said platen while peeling off the pattern of the heat-soluble ink from the surface of said erasable paper.

2. A cleaning apparatus according to claim 1, wherein the heat-soluble resin of the outer surface of said adhesion roller is a toner used in electrophotography.

3. A printer comprising:

a cleaning unit for cleaning an erasable paper having a surface which has been treated with a releasing agent and on which a pattern of a heat-soluble ink has been printed; and a printing unit for effecting printing on the erasable paper passed through said cleaning unit by an electrophotographic method;

wherein said cleaning unit comprises:

an adhesion member having a surface made of a heat-soluble resin which has been placed in a tacky state by heating; and a means for pressing said erasable paper onto the surface of said adhesion member whereby said adhesion member peels off the pattern of the heat-soluble ink from the surface of said erasable paper.

4. A printer comprising:

a cleaning unit for cleaning an erasable paper having a surface which has been treated with a releasing agent and on which a pattern of a heat-soluble ink has been printed; and a printing unit for effecting printing on the erasable paper passed through said cleaning unit by an electrophotographic method;

wherein said cleaning unit comprises:

an adhesion roller having an outer surface made of a heat-soluble resin which has been placed in a tacky state by heating; and a platen for pressing said erasable paper onto the outer surface of said adhesion roller;

said adhesion roller rotating to transport said erasable paper inserted between the outer surface of said adhesion roller and said platen while peeling off the pattern of the heat-soluble ink from the surface of said erasable paper.

* * * * *